US010456834B2

(12) United States Patent
Hermant et al.

(10) Patent No.: US 10,456,834 B2
(45) Date of Patent: Oct. 29, 2019

(54) PROCESS FOR THE PRODUCTION OF SINTERED MOLDINGS

(71) Applicant: BASF SE, Ludwigshafen (DE)

(72) Inventors: Marie-Claire Hermant, Mannheim (DE); Bernd-Steffen Von Bernstorff, Wachenheim (DE)

(73) Assignee: BASF SE, Ludwigshafen am Rhein (DE)

( * ) Notice: Subject to any disclaimer, the term of this patent is extended or adjusted under 35 U.S.C. 154(b) by 273 days.

(21) Appl. No.: 15/315,594

(22) PCT Filed: Jun. 1, 2015

(86) PCT No.: PCT/EP2015/062057

§ 371 (c)(1),
(2) Date: Dec. 1, 2016

(87) PCT Pub. No.: WO2015/185468

PCT Pub. Date: Dec. 10, 2015

(65) Prior Publication Data

US 2018/0185919 A1 Jul. 5, 2018

(30) Foreign Application Priority Data

Jun. 2, 2014 (EP) ..... 14170748

(51) Int. Cl.

| | |
|---|---|
| ***B22F 3/16*** | (2006.01) |
| ***B22F 1/00*** | (2006.01) |
| ***B22F 3/10*** | (2006.01) |
| ***B22F 3/22*** | (2006.01) |
| ***C23F 1/12*** | (2006.01) |
| ***C23F 1/16*** | (2006.01) |

(52) U.S. Cl.

CPC ..... *B22F 3/16* (2013.01); *B22F 1/0062* (2013.01); *B22F 3/225* (2013.01); *C23F 1/12* (2013.01); *C23F 1/16* (2013.01); *B22F 2302/45* (2013.01)

(58) Field of Classification Search

None

See application file for complete search history.

(56) References Cited

U.S. PATENT DOCUMENTS

| | | | | |
|---|---|---|---|---|
| 5,198,489 | A | 3/1993 | Sterzel et al. | |
| 5,611,978 | A | 3/1997 | Truebenbach | |
| 5,737,683 | A | 4/1998 | Sterzel | |
| 6,388,049 | B1 * | 5/2002 | Yokoyama | C08G 2/10 525/398 |
| 2009/0288739 | A1 * | 11/2009 | Wohlfromm | B22F 1/0059 148/522 |
| 2012/0235330 | A1 | 9/2012 | ter Maat et al. | |

FOREIGN PATENT DOCUMENTS

| | | | |
|---|---|---|---|
| CN | 101489704 | A | 7/2009 |
| EP | 0128739 | A1 | 12/1984 |
| EP | 0129369 | A1 | 12/1984 |
| EP | 0413231 | A2 | 2/1991 |
| EP | 0446708 | A2 | 9/1991 |
| EP | 0701875 | A1 | 3/1996 |
| WO | WO-1994025205 | A1 | 11/1994 |

OTHER PUBLICATIONS

Gonzalez-Gutierrez et al., "Time Dependent Properties of Multimodal Polyoxymethylene Based Binder for Powder Injection Molding," J. Solid Mechanics and Materials Engineering, vol. 6, No. 6 (2012), published Jun. 29, 2012. (Year: 2012).*

International Preliminary Examination Report with Annexes (in English) for PCT/EP2015/062057 dated Sep. 16, 2016.

International Search Report for PCT/EP2015/062057 dated Sep. 7, 2015.

* cited by examiner

*Primary Examiner* — Keith Walker
*Assistant Examiner* — John A Hevy
(74) *Attorney, Agent, or Firm* — Drinker Biddle & Reath LLP

(57) ABSTRACT

The present invention relates to an improved process for the production of sintered moldings by molding a mixture of a sinterable ceramic or metallic powder and polyoxymethylene or a copolymer containing a majority of oxymethylene units as binder to give a compact, removing the binder from the compact by treatment with a gaseous acid, and sintering the resulting molding.

11 Claims, No Drawings

PROCESS FOR THE PRODUCTION OF SINTERED MOLDINGS

CROSS-REFERENCE TO RELATED APPLICATIONS

This application is a national stage application (under 35 U.S.C § 371) of PCT/EP2015/062057 filed Jun. 1, 2015, which claims benefit of European Application No. 14170748.9, filed Jun. 2, 2014, both of which are incorporated herein by reference in their entirety.

The present invention relates to an improved process for the production of sintered moldings by molding a mixture of a sinterable ceramic or metallic powder and polyoxymethylene or a copolymer containing a majority of oxymethylene units as binder to give a compact, removing the binder from the compact by treatment with a gaseous acid, and sintering the resulting molding.

Polymer particles marketed with trademark Catamold® comprise inorganic powders, in particular metal powders or ceramic powders. Typically, these powders are first coated with a thin layer of polyethylene and then are compounded into a polyoxymethylene binder. These Catamold granules are then processed by injection molding to give a green product, converted to a brown product by removal of binder, and then sintered to give a sintered molding. The process is known as metal injection molding (MIM) and permits production of metallic or ceramic moldings with complex shapes.

The green products produced with use of polyoxymethylene homo- or copolymers have very good mechanical properties, in particular dimensional stability.

Binder removal is often achieved through exposure to an acidic atmosphere, for example $HNO_3$ atmosphere, at from 110 to 140° C., with decomposition of the POM binder. The acidic depolymerization of the POM permits complete removal of the binder. The thin polyethylene coating of the inorganic particles binds these to one another in the brown product obtained.

The brown product is preferably sintered in a sintering oven at temperatures in the range of about 1100 to 1700° C., to give the desired metal molding or ceramic molding.

EP-A-413 231 describes a process for the production of inorganic sintered moldings in which compacts of sinterable powders and polyoxymethylene as binder are injection molded or extruded. The binder is removed from these compacts by treatment with a gaseous acid or gaseous boron trifluoride, preferably in a stream of inert carrier gas, and the resultant parts are sintered.

EP-A-0 701 875 relates to a process for the production of metallic compacts by powder injection molding. The debindering of polyoxymethylene homo- and copolymers is performed in the presence of an acid which can be nitric acid, oxalic acid or boron trifluoride.

A common feature of both processes is the type of acids to be used for removing the binder, namely acids which are gaseous at room temperature, for example hydrogen halides and hydrogen sulfide, or liquid at room temperature, such as nitric acid, sulfuric acid, formic acid and acetic acid. However, these acids remain in the gas phase and corrode all apparatus parts which come into contact with the gas phase, or form liquid films which are likewise corrosive. In addition, disposal of these gases is not straightforward.

WO 94/25205 relates to a method of producing sintered articles. In the process a mixture of a sinterable ceramic or metallic powder and polyoxymethylene or a copolymer containing a majority of oxymethylene units as binder is molded to give a compact. Subsequently, the binder is removed by treatment with a gaseous acid which is solid at room temperature and sublimes or melts or evaporates when heated. Preference is given to anhydrous oxalic acid or oxalic acid dehydrate. Glyoxalic acid is also described as suitable, as are benzene sulfonic acid, napthaleve sulfonic acids and maleic acid, and mixtures thereof.

In the current process for metal (MIM) and ceramic (CIM) powder injection molding using polyacetal-based binder systems, the oxidizing acid nitric acid is used as a catalyst for the debinding stage. The use of this acid limits the type of metals that can be incorporated into the feedstock. Metals such as copper and aluminum are strongly degraded and oxidized by nitric acid. A non-oxidizing alternative acid that is transferable to the current debinding equipment is required.

The anhydrous oxalic acid or oxalic acid dehydrate are not always successful in achieving this goal.

Therefore, it is an object of the present invention to overcome the problems with the existing acids for binder removal.

The object is achieved by a process for the production of sintered moldings which comprises:

molding a mixture comprising A a sinterable metallic powder and B1 polyoxymethylene or a copolymer containing a majority of oxymethylene units as binder to give a compact (green body), removing the binder from the compact by treatment with a gaseous or liquid acid to obtain a molding (brown body), and sintering the molding, wherein the acid is selected from methanesulfonic acid or a solution of methanesulfonic acid, oxalic acid or mixtures thereof in a solvent, selected from water, $C_{1-4}$-carboxylic acids and mixtures thereof.

Furthermore, the object is achieved by the use of an acid, selected from methanesulfonic acid or a solution of methanesulfonic acid, oxalic acid or mixtures thereof in a solvent, selected from water, $C_{1-4}$-carboxylic acids and mixtures thereof, for removing the binder in a compact of a mixture of a sinterable ceramic or metallic powder and polyoxymethylene or a copolymer containing a majority of oxymethylene units as binder.

Preferably, a mixture (feedstock) is used, comprising:

A.) from 40 to 70% by volume of a sinterable pulverant metal or a sinterable pulverant metal alloy or mixtures thereof;

B.) from 30 to 60% by volume of a binder comprising of the mixture of:

B1.) from 50 to 98% by weight of one or more polyoxymethylene homopolymers or copolymers based on the total amount of the component B;

B2.) from 2 to 35% by weight of one or more polyolefins, based on the total amount of component B;

B3.) from 0 to 40% by weight of poly-1,3-dioxolane, poly-1,3-dioxepane or polytetrahydrofurane or mixtures thereof, based on the total amount of component B, the sum of B1.), B2.) and B3.) adding up to 100% by weight.

Examples of suitable metal powders are Fe, Al, Cu, Nb, Ti, Mn, V, Ni, Cr, Co, Mo, W and Si powders. The metal powders can also be employed in the form of alloys, for example as intermetallic phases such as TiAl, $Ti_3Al$ and $Ni_3Al$. Graphite and carbon black are also suitable. It is of course also possible to use mixtures of said materials. Furthermore, inorganic fibers or whiskers of, for example, $Al_2O_3$, SIC, $Si_3N_4$ or C can be added to the materials, which may also contain auxiliaries, such as dispersants.

Preferably, metal powders are employed which are selected from Cu, Mg, Al and MgAl-alloys, specifically preferred is the use of Cu powder.

The particle size of the powders is generally from 0.005 to 100 μm, preferably from 0.1 to 50 μm, particularly preferably from 0.2 to 30 μm.

Thermoplastic binder B.) compositions suitable for the process for producing metallic moldings are described by way of example in EP-A-0 446 708 and US 2009/0288739 A1.

The binders to be employed according to the invention comprise preferably:

B1.) from 50 to 98% by weight of one or more polyoxymethylene homopolymers or copolymers;

B2.) from 2 to 35% by weight of one or more polyolefins;

B3.) from 0 to 40% by weight of poly-1,3-dioxolane, poly-1,3-dioxepane or polytetrahydrofurane or mixtures thereof, each based on the total amount of component B, the sum of B1.), B2.) and B3.) adding up to 100% by weight.

Component B1 is preferably used in an amount of 60 to 92% by weight, more preferably 70 to 86% by weight.

For component B1, polyoxymethylene and polyoxymethylene blends advantageously have a molecular weight (Mw) of from 10,000 to 500,000 g/mol. In addition to homopolymers of formaldehyde or trioxane, copolymers of trioxane with, for example, cyclic ethers, such as ethylene oxide and 1,3-dioxolane, or formals, such as butanediol formal, are also suitable, the amounts of the comonomers generally being from 1 to 20% by weight of the polymers.

As a preferred constituent B1, a polyoxymethylene copolymer with a weight-average molar mass ($M_W$) in the range from 20 000 to 200 000 g/mol, at least 90% by weight of which, based on the polymer, derived from trioxane and butanediol formal as monomers and butylal as regulator, with a proportion of butanediol formal, based on the polymer, in the range from 1 to 30% by weight, and a proportion of butylal, based on the polymer, in the range from 0.01 to 2.5% by weight, is employed.

Preferably, the weight-average molar mass ($M_W$) is from 30 000 to 60 000 g/mol, preferably from 40 000 to 50 000 g/mol and/or the number-average molar mass ($M_n$) is from 5 000 to 18 000 g/mol, preferably from 8 000 to 16 000 g/mol, in particular from 10 000 to 14 000 g/mol.

Preferably, the $M_W/M_n$ ratio is in the range from 3 to 5, preferably from 3.5 to 4.5.

A second preferred constituent B1 comprises a blend of two polyoxymethylene homo- or copolymer, namely B1.1 and B1.2, in which:

from 10 to 90% by weight of a polyoxymethylene homo- or copolymer with a weight-average molar mass ($M_W$) in the range from above 60 000 to 200 000 g/mol as component B1.1 and from 10 to 90% by weight of a polyoxymethylene copolymer as with a weight-average molar mass ($M_W$) in the range from 10 000 to 60 000 g/mol, as component B1.2.

It is preferable in both B1.1 and B1.2 that the ratio between weight-average molecular weight ($M_W$) and number-average molecular weight (Ma), also termed polydispersity or $M_W/M_n$, is in the range from 3 to 5, preferably from 3.5 to 4.5.

A composition is preferred wherein at least 90% by weight of component B1.1, based on the polymer, derive from trioxane and optionally butanediol formal as monomers, preferably from trioxane and butanediol formal as monomers, with a proportion of butanediol formal, based on the polymer, in the range from 1 to 5% by weight, preferably from 2 to 3.5% by weight, in particular from 2.5 to 3% by weight.

A composition is preferred where in at least 90% by weight of component B1.2 is based on the polymer, derived from trioxane and optionally butanediol formal as monomers, preferably from trioxane and butanediol formal as monomers, with a proportion of butanediol formal, based on the polymer, in the range from 1 to 30% by weight, preferably from 2.7 to 30% by weight, with preference from 2.8 to 20% by weight, in particular from 3 to 17% by weight, and a proportion of butylal, based on the polymer, in the range from 0.7 to 2.5% by weight, preferably 1.0 to 2.0% by weight, in particular 1.0 to 1.3% by weight. Furthermore, this polyoxymethylene copolymer has a weight-average molar mass ($M_W$) in the range from 10 000 to 60 000 g/mol, preferably from 30 000 to 60 000 g/mol, in particular from 40 000 to 50 000 g/mol.

Molecular weights can be determined here as described in the examples. The molecular weights are generally determined by way of gel permeation chromatography (GPC) or SEC (size exclusion chromatography). The number-average molecular weight is generally determined by GPC-SEC, Component B1 is now described in more detail below.

Very generally, polyoxymethylene copolymers (POM) of the invention have at least 50 mol % of —$CH_2O$— repeat units in the main polymer chain. Polyoxymethylene copolymers are preferred which also have, alongside the —$CH_2O$— repeat units, up to 50 mol %, preferably from 0.01 to 20 mol %, in particular from 0.1 to 10 mol %, and very particularly preferably from 0.5 to 6 mol %, of

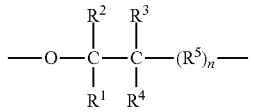

repeat units, where $R^1$ to $R^4$ are mutually independently a hydrogen atom, a $C_1$-$C_4$-alkyl group, or a halogen-substituted alkyl group having from 1 to 4 carbon atoms, and $R^5$ is —$CH_2$—, —$CH_2O$—, or a $C_1$-$C_4$-alkyl or $C_1$-$C_4$-haloalkyl-substituted methylene group, or a corresponding oxymethylene group, and n has a value in the range from 0 to 3. Said groups can advantageously be introduced into the copolymers through ring-opening of cyclic ethers. Preferred cyclic ethers are those of the formula

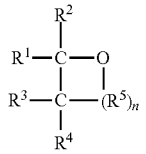

where $R^1$ to $R^5$ and n are as defined above. Merely by way of example, ethylene oxide, propylene 1,2-oxide, butylene 1,2-oxide, butylene 1,3-oxide, 1,3-dioxane, 1,3-dioxolane, and 1,3-dioxepane (=butanediol formal, BUFO) may be mentioned as cyclic ethers, and linear oligo- or polyformals, such as polydioxolane or polydioxepane, may be mentioned as comonomers.

Equally suitable materials are oxymethylene terpolymers which by way of example are produced through reaction of trioxane or of one of the cyclic ethers described above with a third monomer, preferably bifunctional compounds, of the formula

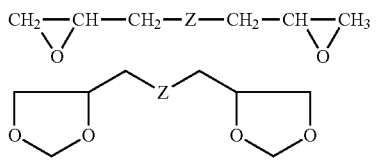

and/or where Z is a chemical bond —O—, —ORO— (R=$C_1$-$C_8$-alkylene or $C_3$-$C_8$-cycloalkylene), Preferred monomers of this type are ethylene diglycide, diglycidyl ether, and diethers derived from glycidyl compounds and formaldehyde, dioxane, or trioxane in a molar ratio of 2:1, and also diethers made of 2 mol of glycidyl compound and 1 mol of an aliphatic diol having from 2 to 8 carbon atoms, for example the diglycidyl ethers of ethylene glycol, 1,4-butanediol, 1,3-butanediol, cyclobutane-1,3-diol, 1,2-propanediol and cyclohexane-1,4-diol, to mention just a few examples.

Particular preference is given to end-group-stabilized polyoxymethylene polymers which have predominantly C—C or —O—$CH_3$ bonds at the chain ends.

At least 90% by weight of the copolymers, based on the polymer, derive from trioxane and butanediol formal as monomers.

The polyoxymethylene copolymers derive, preferably exclusively, from trioxane and butanediol formal as monomers, with a proportion of butanediol formal, based on the polymer or on the monomers, in the range from 1 to 30% by weight, preferably from 2.7 to 30% by weight, with preference from 2.8 to 20% by weight, in particular from 3 to 10% by weight.

The molecular weights of the polymer are adjusted to the desired values by using butylal as regulators or chain transfer agent.

The use of butylal (n-butylal) as regulator has the advantage that it is nontoxic, whereas methylal is classified as toxic. The use of butylal as regulator represents a further advantage in comparison with the polyoxymethylene copolymers known from U.S. Pat. No. 6,388,049.

It is therefore preferable to use butylal as regulator in the production of the polymer. It is preferable to use an amount of from 0.1 to 5% by weight, based on the polymer, particularly from 0.2 to 4% by weight, in particular from 0.3 to 2% by weight, of butylal.

In conjunction with the specific amount of comonomer and with the specific molecular weight, polyoxymethylene copolymers are obtained with particularly suitable mechanical properties which make them suitable as viscosity-modifying additive for polyoxymethylene homo- or copolymers with higher molecular weight, without any major impairment of mechanical properties, in particular hardness. Flexural strength and fracture strength also remain on a high level.

The specific combination of molecular weight, proportion of comonomer, selection of comonomer, proportion of regulator, and selection of regulator in the polyoxymethylene copolymers leads to particularly suitable mechanical properties, which permit the advantageous use as viscosity-modifying additive for higher-molecular-weight polyoxymethylene homo- or copolymers.

Initiators used (also termed catalysts) are the cationic initiators conventional in trioxane polymerization. Protic acids are suitable, for example fluorinated or chlorinated alkyl- and arylsulfonic acids, examples being perchloric acid and trifluoromethanesulfonic acid, or Lewis acids, e.g. tin tetrachloride, arsenic pentafluoride, phosphorus pentafluoride, and boron trifluoride, as also are their complex compounds and salt-like compounds, examples being boron trifluoride etherates and triphenylmethyl hexafluorophosphate. The amounts used of the initiators (catalysts) are about 0.01 to 1000 ppm, preferably 0.01 to 500 ppm, and in particular from 0.01 to 200 ppm. It is generally advisable to add the initiator in dilute form, preferably at concentrations of from 0.005 to 5% by weight. Solvents used for this purpose can be inert compounds, such as aliphatic or cycloaliphatic hydrocarbons, e.g. cyclohexane, halogenated aliphatic hydrocarbons, glycol ethers, etc. Butyldiglyme (diethylene glycol dibutyl ether) and 1,4-dioxane are particularly preferred as solvents, specifically butyldiglyme.

The invention particularly preferably uses, as cationic initiators, an amount in the range from 0.01 to 1 ppm (preferably from 0.02 to 0.2 ppm, in particular from 0.04 to 0.1 ppm), based on the entirety of monomers and regulator, of Brönsted acids. In particular, $HClO_4$ is used as cationic initiator.

In addition to the initiators, cocatalysts can be used concomitantly. These are alcohols of any type, examples being aliphatic alcohols having from 2 to 20 carbon atoms, such as tert-amyl alcohol, methanol, ethanol, propanol, butanol, pentanol, hexanol; aromatic alcohols having from 2 to 30 carbon atoms, such as hydroquinone; halogenated alcohols having from 2 to 20 carbon atoms, such as hexafluoroisopropanol; very particular preference is given to glycols of any type, in particular diethylene glycol and triethylene glycol; and aliphatic dihydroxy compounds, in particular diols having from 2 to 6 carbon atoms, such as 1,2-ethanediol, 1,3-propanediol, 1,4-butanediol, 1,6-hexanediol, 1,4-hexanediol, 1,4-cyclohexanediol, 1,4-cyclohexanedimethanol, and neopentyl glycol.

Monomers, initiators, cocatalyst, and optionally regulator can be premixed in any desired manner, or else can be added separately from one another to the polymerization reactor.

The components for stabilization can moreover comprise sterically hindered phenols, as described in EP-A 129369 or EP-A 128739.

The polyoxymethylene copolymers of component B1.2 are produced by polymerization of trioxane, butanediol formal and optionally further comonomers in the presence of at least one cationic initiator and of butylal as regulator.

It is preferable that the polymerization mixture is deactivated, preferably without any phase change, directly after the polymerization reaction. The initiator residues (catalyst residues) are generally deactivated by adding deactivators (terminators) to the polymerization melt. Examples of suitable deactivators are ammonia, and also primary, secondary, or tertiary, aliphatic and aromatic amines, e.g. trialkylamines, such as triethylamine, or triacetonediamine. Other suitable compounds are salts which react as bases, for example soda and borax, and also the carbonates and hydroxides of the alkali metals and of the alkaline earth metals, and moreover also alcoholates, such as sodium ethanolate. The amounts of the deactivators usually added to the polymers are preferably from 0.01 ppmw (parts per million by weight) to 2% by weight. Preference is further given to alkyl compounds of alkali metals and of alkaline earth metals as deactivators, where these have from 2 to 30 carbon atoms in the alkyl moiety. Li, Mg, and Na may be mentioned as particularly preferred metals, and particular preference is given to n-butyllithium here.

In one embodiment of the invention, from 3 to 30 ppm, preferably from 5 to 20 ppm, in particular from 8 to 15 ppm, based on the entirety of monomers and regulator, of a chain terminator can be used concomitantly. Sodium methoxide is in particular used as chain terminator here.

POM made of trioxane and butanediol formal is generally obtained by polymerization in bulk, and any reactors with a high level of mixing action can be used for this purpose. The reaction here can be conducted homogeneously, e.g. in a melt, or heterogeneously, e.g. as polymerization to give a solid or solid granules. Examples of suitable equipment are tray reactors, plowshare mixers, tubular reactors, list reactors, kneaders (e.g. Buss kneaders), extruders, for example those having one or two screws, and stirred reactors, and the reactors here may have static or dynamic mixers.

The lower molecular weight POM of component B1.2 can be produced particularly advantageously by using a small amount of initiator, a large amount of regulator, and capping the chain ends. The resultant POM with medium molecular weight is not only heat-resistant but also chemicals-resistant, and its viscosity can be lower by a factor of up to 1000 when it is compared with a conventional POM with high molecular weight, as used hitherto in Catamold compositions.

When the lower molecular weight POM of component B1.2 is used as viscosity-modifying additive for POM with a weight-average molar mass of above 60 000 g/mol, preferably at least 80 000 g/mol of component B1.1, the addition gives a POM system which is thermally and chemically stable and the viscosity of which can be reduced significantly.

For the structure of component B1.1 and production thereof, reference may be made to the statements above relating to component B1.2, with the exception of the molecular weight, of the $M_W/M_n$ ratio, and of the amounts of regulator and of cationic initiator. Furthermore, it is not necessary (but nevertheless preferred) that the comonomer butanediol formal is used concomitantly in component B1.1.

It is particularly preferable that both of components B1.1 and B1.2 are copolymers, in particular using the same comonomers in the same proportions of comonomer.

The amount of cationic initiator in the production process is preferably from 0.05 to 2 ppm, particularly preferably from 0.1 to 1 ppm.

The $M_W/M_n$ ratio of the resultant polyoxymethylene homo- or copolymers of component B1 is preferably in the range from 3.5 to 9, particularly from 4 to 8, in particular from 4.2 to 7.7.

In an embodiment of the invention, the thermoplastic compositions of the invention use from 10 to 90% by weight, preferably from 30 to 90% by weight, in particular from 50 to 90% by weight, of component B1.1 and correspondingly from 10 to 90% by weight, preferably from 10 to 70% by weight, in particular from 10 to 50% by weight, component B1.2.

The thermoplastic compositions are produced by separate production of components B1.1 and B1.2 and then mixing the two components. The mixing here can be achieved in any desired suitable apparatuses, such as kneaders or extruders. It is possible here to begin with mechanical premixing of solid particulate components B1.1 and B1.2, and then to melt these together. It is also possible to melt component B.1 in an extruder and to add component B1.2 to said melt. The mixing process preferably takes place at a temperature in the range from 150 to 220° C., in particular from 180 to 200° C., under a pressure in the range from 0.5 to 5 bar, in particular from 0.8 to 2 bar.

Component B2 comprises polyolefins or mixtures thereof in an amount of from 2 to 35% by weight preferably from 3 to 20 by weight, particularly preferably from 4 to 15% by weight, based on the total amount of the binder B.). Examples of preferred polymers are those derived from $C_{2-8}$-olefins, in particular from $C_{2-4}$-olefins such as ethylene and propylene, vinylaromatic monomers such as styrene and alpha-methylstyrene, vinyl esters of aliphatic $C_{1-8}$-carboxylic acids, e.g. vinyl acetate and vinyl propionate, vinyl $C_{1-8}$-alkyl ethers such as vinyl methyl ether and vinyl ethyl ether, and $C_{1-12}$-alkyl(meth)acrylates such as methyl methacrylate and ethyl methacrylate. Component B2 is preferably at least one polymer of ethylene, propylene or a copolymer of these monomers.

Polymers suitable as component B3 are poly-1,3-dioxepane, poly-1,3-dioxolane, polytetrahydrofurane or mixtures thereof in an amount of from 0 to 40% by weight, or, if present, 2 to 40% by weight (in that case the upper limit for component B1 being 96% by weight instead of 98% by weight), preferably 5 to 30% by weight, more preferably from 10 to 26% by weight, based on the total amount of binder B.). Poly-1,3-dioxepane is particularly preferred.

After all the components have been mixed, for example in a compounder or extruder, the materials are molded, for example by injection molding in conventional screw or plunger injectionmolding machines, at from 160° C. to 200° C. and at from 500 to 2 000 bar.

The resultant compacts are treated with acids, which degrade the binder polyoxymethylene to give gaseous products, predominantly formaldehyde. The gaseous degradation products are usually removed from the reaction zone.

The acid employed in the process according to the present invention is selected from methanesulfonic acid or a solution of methanesulfonic acid, oxalic acid or mixtures thereof in a solvent, selected from water, $C_{1-4}$-carboxylic acids and mixtures thereof.

The treatment with these acids can be employed in the liquid or preferably in the gas phase. When employing the acids in the gas phase, they are preferably employed together with the solvent mentioned above.

Preferably, the amount of methanesulfonic acid, oxalic acid or mixture thereof, in the acid/solvent mixture is in the range of from 1 to 100 wt % more preferably 3 to 90 wt %, especially 5 to 80 wt %.

The $C_{1-4}$-carboxylic acid is preferably selected from formic acid, acetic acid and propionic acid, specifically it is formic acid.

In the most preferred embodiment, the binder is removed by treatment with a gaseous acid, selected from a solution of methanesulfonic acid, oxalic acid or mixtures thereof, in a solvent, selected from water, $C_{1-4}$-carboxylic acids and mixtures thereof. The preferred carboxylic acid is formic acid.

The most preferred acid combinations include:

Methanesulfonic acid+formic acid

Methanesulfonic acid+water

Oxalic acid+formic acid

Oxalic acid+water.

Whereas in the prior art process using nitric acid, the nitric acid must be anhydrous, and in contrast to employing anhydrous oxalic acid or oxalic acid dehydrate, the acids employed according to the present invention can be employed as aqueous solutions or as solutions in $C_{1-4}$-carboxylic acids.

Oxalic acid is a solid at room temperature, and methanesulfonic acid has a high boiling point of 167° C./10 mm Hg. Therefore, it is preferred to employ both acids in a solution in water, $C_{1-4}$-carboxylic acid, preferably $C_{1-3}$-carboxylic acid or mixtures thereof.

During binder removal, these acids can be employed either alone or together with a carrier gas, such as air, nitrogen or a noble gas.

At the binder-removal temperature, the acids to be used according to the invention are first converted into the gas phase, where they act on the binder.

In order to simplify metering, it may be expedient to employ the abovementioned acids as solutions in polar solvents, preferably having boiling points of below 200° C. Suitable solvents are, in particular, acetone, dioxane, ethanol and acetonitrile.

The temperature during binder removal is generally from 100° C. to 160° C., preferably below the softening point of the binder.

The binder removal can be carried out under reduced pressure or preferably at atmospheric pressure, in which case a carrier gas, in particular nitrogen, is also used. There is no need for the carrier gas when binder removal is carried out under reduced pressure.

The process according to the present invention has the advantage that complete binder removal can be effected by non-oxidizing organic acids which allow employing oxidation sensitive metal powders in the MIM molding materials.

The invention claimed is:

1. A process for the production of sintered moldings which comprises:

molding a mixture comprising

A. a sinterable metallic powder and

B. a binder comprising polyoxymethylene or a polyoxymethylene copolymer having at least 50 mol % of —$CH_2O$— repeat units in the main polymer chain to give a compact;

removing the binder from the compact by treatment with a gaseous acid to obtain a molding; and sintering the molding;

wherein the acid is selected from the group consisting of methanesulfonic acid, a mixture of methanesulfonic acid with oxalic acid, a solution of methanesulfonic acid in a solvent selected from the group consisting of water, $C_{1-4}$-carboxylic acids and mixtures thereof, a solution of a mixture of methanesulfonic acid and oxalic acid in a solvent selected from water, $C_{1-4}$-carboxylic acids and mixtures thereof, and a solution of oxalic acid in water, wherein B is a thermoplastic composition comprising from 10 to 90% by weight of a polyoxymethylene homo- or copolymer with a weight-average molar mass ($M_w$) in the range from above 60,000 to 200,000 g/mol as component B1.1 and from 10 to 90% by weight of a polyoxymethylene copolymer with a weight average molar mass ($M_w$) in the range from 10,000 to 60,000 g/mol, as component B1.2, the molecular weights being determined by way of gel permeation chromatography.

2. The process of claim 1, wherein the amount of methanesulfonic acid, oxalic acid, or mixtures thereof, in the acid/solvent mixture is in the range of from 1 to 100 wt %.

3. The process of claim 1, wherein the $C_{1-4}$-carboxylic acid is selected from the group consisting of formic acid, acetic acid and propionic acid.

4. The process of claim 1, wherein the metallic powder is selected from the group consisting of Cu, Mg, Al, and MgAl-alloys.

5. The process of claim 1, wherein the mixture comprises

A. from 40 to 70% by volume of the sinterable pulverant metal, the sinterable pulverant metal alloy, or the mixture thereof;

B. from 30 to 60% by volume of the binder, the binder comprising:

B1.) from 50 to 98% by weight of the polyoxymethylene homopolymers or copolymers B1.1 and B1.2 based on the total amount of the component B;

B2.) from 2 to 35% by weight of one or more polyolefins, based on the total amount of component B;

B3.) from 0 to 40% by weight of poly-1,3-dioxolane, poly-1,3-dioxepane or polytetrahydrofuran or mixtures thereof, based on the total amount of component B, wherein the sum of B1, B2, and B3 add up to 100% by weight of component B.

6. The process of claim 5, wherein at least 90% by weight of component B1.1, based on the polyoxymethylene homo- or copolymer, is derived from trioxane and optionally butanediol formal as monomers.

7. The process of claim 5, wherein at least 90% by weight of component B1.1, based on the polyoxymethylene homo- or copolymer, is derived from trioxane and butanediol formal as monomers, with a proportion of butanediol formal, based on the polymer, in the range from 1 to 5% by weight.

8. The process of claim 5, wherein at least 90% by weight of component B1.1, based on the polyoxymethylene homo- or copolymer, is derived from trioxane and butanediol formal as monomers, with a proportion of butanediol formal, based on the polymer, in the range from 2 to 3.5% by weight.

9. The process of claim 5, wherein at least 90% by weight of component B1.1, based on the polyoxymethylene homo- or copolymer, is derived from trioxane and butanediol formal as monomers, with a proportion of butanediol formal, based on the polymer, in the range from 2.5 to 3% by weight.

10. The process of claim 1, wherein the binder is removed at atmospheric pressure or under reduced pressure.

11. The process of claim 1, wherein the acid is selected from the group consisting of methane sulfonic acid, and a combination of methane sulfonic acid with formic acid or water.

* * * * *